US011174087B2

(12) United States Patent
Bannas

(10) Patent No.: US 11,174,087 B2
(45) Date of Patent: Nov. 16, 2021

(54) DRINKING GLASS AND COMBINATION OF A BEVERAGE BOTTLE AND A DRINKING GLASS

(71) Applicant: Jirko Bannas, Hamburg (DE)

(72) Inventor: Jirko Bannas, Hamburg (DE)

( * ) Notice: Subject to any disclaimer, the term of this patent is extended or adjusted under 35 U.S.C. 154(b) by 271 days.

(21) Appl. No.: 15/764,761

(22) PCT Filed: Sep. 1, 2016

(86) PCT No.: PCT/EP2016/070599

§ 371 (c)(1),
(2) Date: May 7, 2018

(87) PCT Pub. No.: WO2017/037164

PCT Pub. Date: Mar. 9, 2017

(65) Prior Publication Data

US 2018/0244453 A1 Aug. 30, 2018

(30) Foreign Application Priority Data

Sep. 3, 2015 (DE) ..... 102015114732.7

(51) Int. Cl.

| | |
|---|---|
| ***B65D 77/04*** | (2006.01) |
| ***B65D 41/26*** | (2006.01) |
| ***A47G 19/22*** | (2006.01) |
| ***B65D 1/02*** | (2006.01) |
| ***B65D 85/72*** | (2006.01) |

(52) U.S. Cl.

CPC ..... *B65D 77/0486* (2013.01); *A47G 19/2205* (2013.01); *B65D 1/0276* (2013.01); *B65D 41/26* (2013.01); *B65D 85/72* (2013.01)

(58) Field of Classification Search

CPC .. B65D 77/0486; B65D 1/0276; B65D 41/26; B65D 85/72; B65D 75/002; B65D 1/265; B65D 41/04; A47G 19/2205

USPC ..... 206/217; 220/703, 23.87–23.89

See application file for complete search history.

(56) References Cited

U.S. PATENT DOCUMENTS

D199,461 S * 10/1964 Dailey ..... D9/716
3,191,645 A * 6/1965 Dailey ..... B65D 41/26 141/381
3,275,180 A * 9/1966 Optner ..... B65D 77/0493 206/521

(Continued)

FOREIGN PATENT DOCUMENTS

DE 2759098 A1 2/1979
DE 8715991 6/1988

(Continued)

*Primary Examiner* — Chun Hoi Cheung
(74) *Attorney, Agent, or Firm* — Thomas M. Freiburger

(57) ABSTRACT

The invention relates to a drinking glass, which contains a bottom (3) and a wall and can be detachably placed onto the upper end of a beverage bottle (1) in the opposite direction, wherein the wall of the drinking glass (2) at least partially surrounds the beverage bottle (1). According to the invention, the inside of the wall of the drinking glass (2) follows the outer wall of the beverage bottle (1) at a slight distance over the entire height of the drinking glass (2). The drinking glass is able to hold substantially the entire content of the beverage bottle. The drinking glass (2) can be fastened to and detached from the lower end of the beverage bottle at the opening rim of the drinking glass.

4 Claims, 6 Drawing Sheets

(56) References Cited

U.S. PATENT DOCUMENTS 4,150,761 A * 4/1979 Collins ..... B65D 41/26 215/228
D251,950 S * 5/1979 McGowen ..... D9/716
D255,648 S * 7/1980 Bolter ..... D9/716
4,230,230 A * 10/1980 Mumford ..... B65D 41/18 215/277
4,273,247 A * 6/1981 Earls ..... B65D 51/18 215/228
4,389,311 A * 6/1983 La Freniere ..... C02F 1/002 141/98
4,544,073 A * 10/1985 Willis ..... B65D 51/18 215/12.1
4,630,742 A * 12/1986 Miyaji ..... A47J 41/0016 215/12.1
4,693,410 A * 9/1987 Selz ..... A47G 19/2205 229/400
D419,868 S * 2/2000 DeVore ..... D9/716
7,775,393 B1 * 8/2010 Feldman ..... A47G 19/2205 215/229
8,944,265 B2 * 2/2015 Blake ..... B65D 41/56 215/387
9,227,772 B2 * 1/2016 Perrulli ..... B65D 1/0276
2004/0262173 A1 * 12/2004 Buesching ..... B65D 1/04 206/217
2011/0132781 A1 * 6/2011 Willat ..... B65D 1/0276 206/217
2012/0168451 A1 * 7/2012 Lee ..... B65D 41/26 220/711
2015/0344194 A1 * 12/2015 Candy ..... G01F 19/002 206/459.5

FOREIGN PATENT DOCUMENTS

DE 29800793 U1 4/1998
DE 102009036841 2/2011
JP 559114141 U 8/1984
JP H08198309 A 8/1996
WO WO2004005151 1/2004
WO WO2005009853 2/2005
WO WO2006085779 8/2006

* cited by examiner

DRINKING GLASS AND COMBINATION OF A BEVERAGE BOTTLE AND A DRINKING GLASS

This application claims priority from German patent application number DE 102015114732.7, filed Sep. 3, 2015, and PCT/EP2016/070599, filed Sep. 1, 2016.

BACKGROUND OF THE INVENTION

The invention relates to a drinking glass that may be placed in the inverted direction onto a beverage bottle, as well as a combination of a beverage bottle and a drinking glass, in which the drinking glass can be detachably placed on a beverage bottle.

Beverage bottles, such as beer, wine and champagne bottles, are sold either as single bottles or kept in beverage crates, which contain storage compartments arranged in a grid meant for either 6, 12 or 24 bottles, or also kept in cardboard cases, which usually store 2-6 bottles.

For the purpose of drinking the content of a bottle, usually drinking glasses are used, which have to be bought separately or need to be provided on their own.

As a special sales promotion measure it is also known to either add a drinking glass to a beverage crate fully filled with beverage bottles or to add a drinking glass instead of a bottle into the beverage crate. The adding of a drinking glass to a fully filled beverage crate is usually obstructive, because if the drinking glass consists of glass, it can break easily.

In the packaging industry, it is also known to equip bottles with a screw cap that can also be used as a measuring cup. This can primarily be found in the fields of detergents, liquid fertilizer or medicine products. In these cases, the screw caps in use have an enhanced or lowered rim, so that the screw caps can contain measurable volumes of the content of a bottle.

It is also known to sell beverage bottles with a cup that is slipped over the bottle, for example in the form of thermos bottles or according to the way described in DE 87 15 991 UI. These drinking cups are often tightened with a screw thread to the bottle, in addition to the beverage bottle having an additional top that can be covered in a composite unit of beverage bottle and drinking cup.

DE 10 2009 036 841 A1 shows in FIG. 1 an inverted beverage bottle, whose opening has been screwed into the bottom of a drinking glass. To empty the beverage bottle and transfer the content to the drinking glass, the beverage bottle is screwed out of the drink glass and pulled out upwards. Through these means, the content of the bottle pours into the drinking glass, which is then used for drinking just as would a normal drinking glass.

An important disadvantage of this design is that the drinking glass cannot be put onto standard, factory-produced, closed bottles. The drinking glass and beverage bottle therefore must be assembled in the factory, since a later merging of the two is not possible for logistical reasons. Another disadvantage is that the content of the beverage bottle must be poured entirely into the drinking glass, so that no partial filling from the beverage bottle is possible.

DE 298 00 793 UI shows a combination of beverage bottle and drinking glass, in which a cap anchored into the bottom of the drinking glass is used to seal the beverage bottle in use. In this case, the drinking glass must also be merged to the beverage bottle in the factory. Another disadvantage of the design of the citation is again that once the drinking glass is used, it can usually not be placed onto the beverage bottle again, since drink remnants in the drinking glass could drip down the bottle surface.

The primary object of the present invention is to provide a drinking glass, which is detachably placeable in the inverted direction on the upper end of a beverage bottle, whose form is adjusted to the beverage bottle and which may essentially contain the entire content of a beverage bottle. Another object of the invention is to provide a drinking glass that has a mount and is a combination of a drinking glass and beverage bottle, which form a solid but detachable unit and in which the drinking glass and the beverage bottle are adapted to each other in volume and also form.

These objects are met in the independent claims of the invention. Further advantageous embodiments of the invention are specified in the subclaims.

SUMMARY OF THE INVENTION

The invention is based on a combination of a beverage bottle and a drinking glass, in which the drinking glass having a bottom and wall is detachably placeable in the inverted direction on the upper end of the beverage bottle, and wherein the wall of the drinking glass at least partially surrounds the beverage bottle.

According to invention, the inside wall of the drinking glass essentially follows, over the entire height of the drinking glass, the outer wall of the beverage bottle at a slight distance therefrom, and the drinking glass is able to accommodate essentially the entire volume of the beverage bottle. The drinking glass is fastenable by its open rim to the lower end of the beverage bottle and is detachable therefrom.

In another embodiment of the invention, the drinking glass includes a bracket in the area of its bottom inner side, which can be connected to the head of the beverage bottle and also be detached from it, wherein the inside wall of the drinking glass follows, over a substantial part of the height of the beverage bottle, the outer wall of the beverage bottle at a slight distance therefrom and wherein the clamp connection includes protrusions designed to be flexible and to engage behind the closure or a ridge of the head of the beverage bottle.

On the one hand, with such a combination, the drinking glass is firmly attached to the beverage bottle and encompasses the beverage bottle to a substantial degree, so that a big part or preferably the entire volume of the beverage bottle can be accommodated by the drinking glass. On the other hand, the drinking glass can be also easily detached from the beverage bottle.

Since in this invention, the inside wall of the drinking glass extends a substantial amount of the height of the beverage bottle to the outer rim of the beverage bottle at a slight distance therefrom, the entire diameter of the combination increases only slightly by inverting the drinking glass onto the beverage bottle, so that the combination can be inserted without difficulty into a storage compartment of a beverage crate.

When the mounting of the drinking glass and beverage bottle occurs through a clamp connection by means of webs or lamellae, the clamp connections extend over onto the seal at the head of the beverage bottle and/or a ridge at the head of the beverage bottle. The clamp force has preferably been chosen in such a way that lifting the combination of beverage bottle and drinking glass is possible just by gripping the drinking glass.

Such a clamp connection is preferably formed with several webs, which are aligned in a circle at the bottom inside of the drinking glass. Alternatively, it is carried out by lamellae separated in peripheral direction and protruding from the bottom inside, which encompass the head of the beverage bottle. When placing a drinking glass having such a clamp connection onto a beverage bottle, the webs and lamellae are pressed apart slightly, so that they cause the clamp connection through their radial pretension when they reach their final position.

Herein, the webs or lamellae protruding from the bottom inner side of the drinking glass show edges directed radially towards the longitudinal axis of the drinking glasses and which encompass the lower rim of the beverage bottle seal or the ridge at the head of the beverage bottle. By means of this, the mounting force in the axial direction of the beverage bottle can be improved significantly. The edges are preferably designed in bale shape or are rounded, so that the clamp force can be overcome more easily.

In order to remove the drinking glass from the beverage bottle, the drinking glass is pulled off from the head of the beverage bottle in longitudinal direction, wherein the webs or lamellae of the clamp seal are bent radially towards the outside and release the drinking glass.

In the preferred alternative embodiment, the edges are arranged immediately onto the inside of bottleneck of the wall of the drinking glass without the webs or lamellae. Here, the edges are either formed flexibly or the drinking glass is shaped flexibly in this area, so that the edge can encompass the ridge of the beverage bottle in this embodiment.

Since the inside wall of the drinking glass follows an essential part of the height of the beverage bottle at a slight distance therefrom at the exterior wall of the beverage bottle, a vacuum between the exterior wall of the beverage bottle and the inside wall of drinking glass can easily form when pulling off the drinking glass from the beverage bottle, as this can impede the detaching of the drinking glass from the beverage bottle. This can be prevented in an effective manner, if the inside wall of the drinking glass contains several web-like profiles, which are spread out over the inner circumference in longitudinal or diagonal direction, and which protrude from the inside wall of the drinking glass and define a fixed distance between the inside wall of the drinking glass and the exterior wall of the beverage bottle and therefore form an open space between drinking glass and beverage bottle, which prevents a vacuum.

Preferably, the distance between the opening rim of the drinking glass and the bottom of the beverage bottle is 1-2 cm. In that way, the bottom of the beverage bottle can be held when pulling off the drinking glass and therefore, the clamp force between drinking glass and beverage bottle can be overcome.

According to another preferred embodiment, an essentially smooth top is arranged to the bottom of the beverage bottle, which contains a flange on the side that encompasses the bottom rim of the beverage bottle. The opening rim of the drinking glass, which sits on top of the beverage bottle, preferably collides with the top of the flange, so that in the case of the same diameter between the outer wall of the drinking glass and the flange, there is no protrusion of the opening rim of the drinking glass. This avoids damaging the opening rim of the drinking glass when packaging up and transporting such a combination.

The cover with flange hub is preferably attached to the drinking glass by means of a circumferential banderole. In this way, the opening rim of the drinking glass can be protected and the hygienic demands are being met. When using such a designed sales unit, the banderole will be pulled off first, then the bottom-sided cover will be taken off and after gripping the bottom of the beverage bottle, the drinking glass will be pulled off from the top. The bottom-sided cover can be used as a coaster. The flange of the cover can also be designed to be separable from the cover, especially by perforating the cover material.

The banderole prevents an unintentional separation of beverage bottle and drinking glass in case of a decreased clamp force of mounting at the bottom of the drinking glass.

Instead of using the cover on the bottom of the beverage bottle and attaching the drinking glass with the banderole to the cover, the drinking glass, according to the invention, can also be attached directly to the beverage bottle by means of adhesive or glue strips or an adhesive banderole. In this way, the opening rim of the drinking glass is also protected and the drinking glass and beverage bottle are solidly connected to each other. In this case, there is no need for a mounting of the bottom inner side of the drinking glass. Then the drinking glass is attached only via adhesive or glue strips to the bottom of the beverage bottle. A handle area at the bottom of the beverage bottle is not required, but it is preferred, in order to secure the opening rim of the drinking glass, to keep a space of 0.5-2 cm between the opening rim and the bottom of the drinking glass.

Even though the inventive combination can be used especially for beer bottles, and here especially for wheat beer bottles, its usage is not limited to these type of bottles, but instead the invention can be equally used for wine bottles, champagne bottles, piccolo bottles or juice bottles. In this case, the drinking glass must be adjusted to the form and height of the respective beverage bottle, while keeping the same basic construction.

The invention is not limited to a certain type of seal, but can also be used with crown cork seals, for screw caps or also cork seals.

In order to comply with the hygienic and food law demands, the drinking glass preferably consists of food-safe, break-proof synthetic material, which is transparent, translucent or also designed in different color variations. The material is in particular PLA, PET, PP, PS. To see the imprint of the beverage bottle from the outside, a clear, glass-like synthetic material is preferred.

DESCRIPTION OF THE DRAWINGS

The invention is explained in further detail by means of a design example below. In the figures:

FIG. 1 shows a beverage bottle 1, which for example can be designed as a standard wheat beer bottle. A major part of its height is designed in cylinder form and has a bottle neck 30, which is tapered in the direction of the bottle head, which contains a ridge 15 and a crown cork seal 14 at the opening. The bottom side 16 of the beverage bottle is smooth or has a slight indentation.

Figure 1:
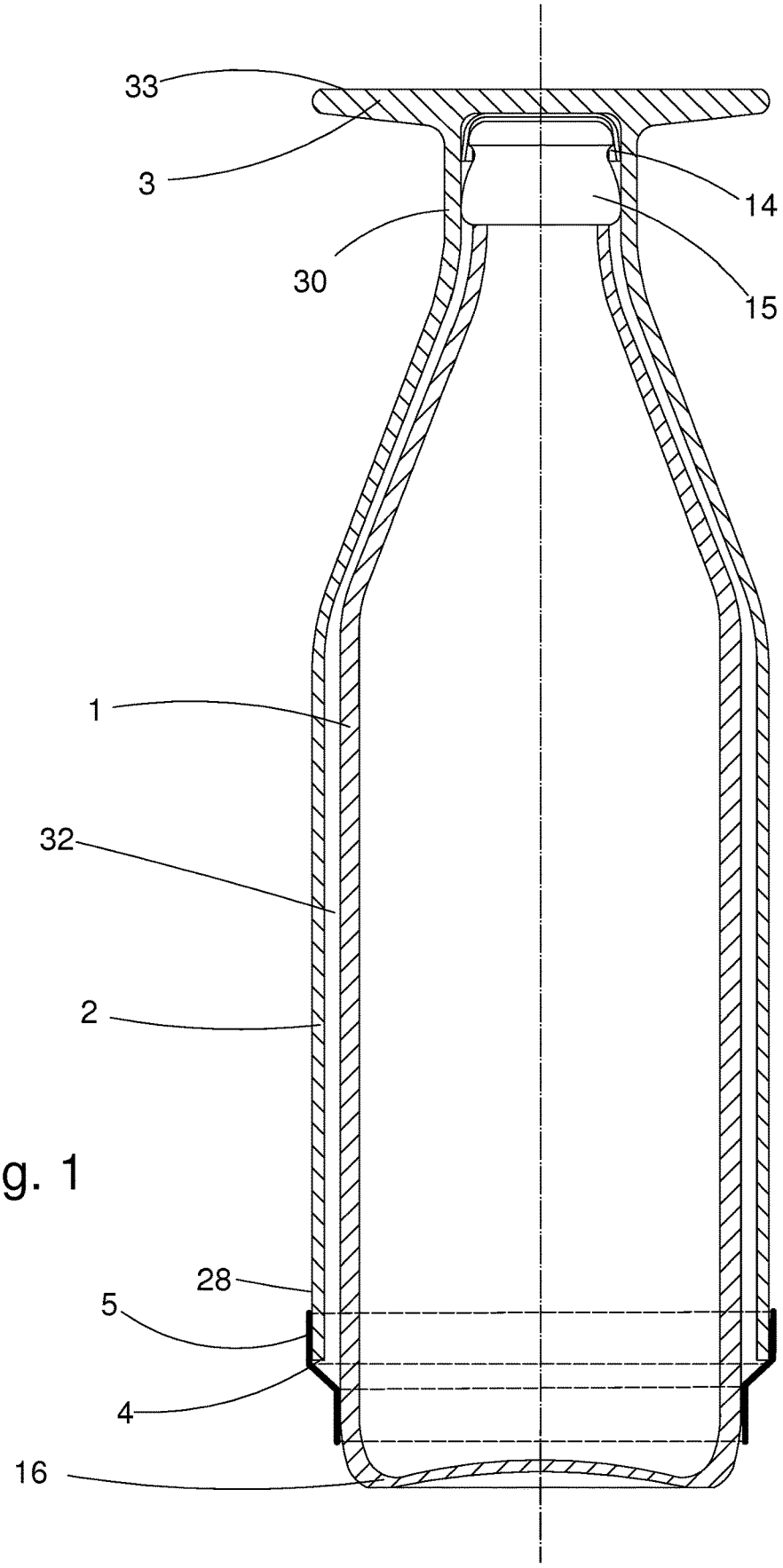
FIG. 1 shows a presentation of a combination of a beverage bottle and drinking glass according to a first embodiment.

The drinking glass 2 in its wall form substantially follows the form of beverage bottle 1, whereas the inside diameter of the drinking glass with a space of 1-3 mm is only slightly larger than the outside diameter of the beverage bottle 1. The bottom 3 of the drinking glass 2 shows a printable surface area 33, the size of which can be designed differently, according to the intended use. When using it as a champagne glass, the surface area can also be connected through a connection handle with the drinking glass body 2.

The drinking glass can be almost entirely put onto the beverage bottle in the inverted direction, as shown in FIG. 1. In order to connect the drinking glass and the beverage bottle, a circumferential banderole 5 made of paper or plastic is lead across the bottom part of the outer wall 28 of the drinking glass with the opening rim 4 of the drink glass 2 and the bottom of the beverage bottle. This banderole connects drinking glass 2 and beverage bottle 1 by means of adhesive or glue force and at the same time it hygienically covers the opening rim 4 of the drinking glass. The banderole 5 can also be made of individual horizontal or vertical stripes, which can also be round or oval, or designed with a rubber sleeve. In addition, a rubber silicone ring can be inserted at the opening rim of the drinking glass, which makes for a tether between drinking glass and beverage bottle.

In an even easier embodiment, drinking glass 2 and beverage bottle 1 can be connected without a mount and banderole as a unit by means of a shrink film.

To remove the drinking glass 2 from the beverage bottle 1, the banderole 5, which has a handy tap, or the cuff are removed and the drinking glass 2 can be easily pulled off the beverage bottle 1.

The volume of the drinking glass is designed in such a way, that the entire content of the beverage bottle can be absorbed by it.

Figure 2:
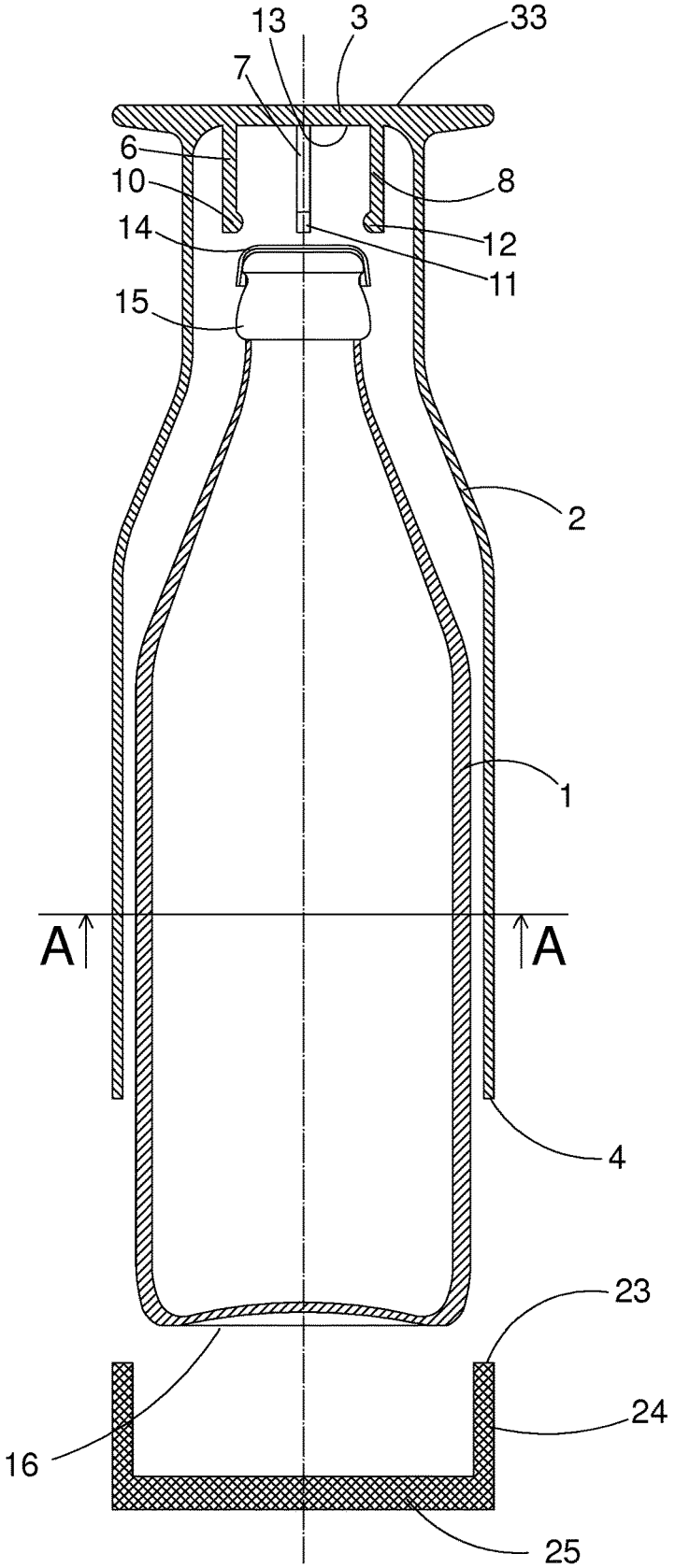
FIG. 2 shows a presentation of a combination of a beverage bottle and drinking glass according to a second embodiment.

FIG. 2 shows a connection of drinking glass 2 and beverage bottle 1 by means of a mount arranged in the bottom inner side of the drinking glass.

In the bottom inner side 13 of the drinking glass 2, there are several webs 6, 7, 8, which run in axial direction and are circumferentially arranged, and which contain at their far end protrusions 10, 11, 12 that are radially directed towards the inside. The webs are solidly connected with the bottom inner side 13 of the drinking glass or the integral part of the drinking glass 2 and are slightly bendable in radial direction. When such a drinking glass is being pulled over a beverage bottle in the illustrated way, the webs 6-8 bend outwards and either encompass the crown caps 14 or also the ridge 15 of the beverage bottle. Its protrusions 10-12 reach out to the crown caps 14 or the ridge 15 and keep the drinking glass tightly connected to the beverage bottle 1 in their end position and by means of tension.

Figure 3:
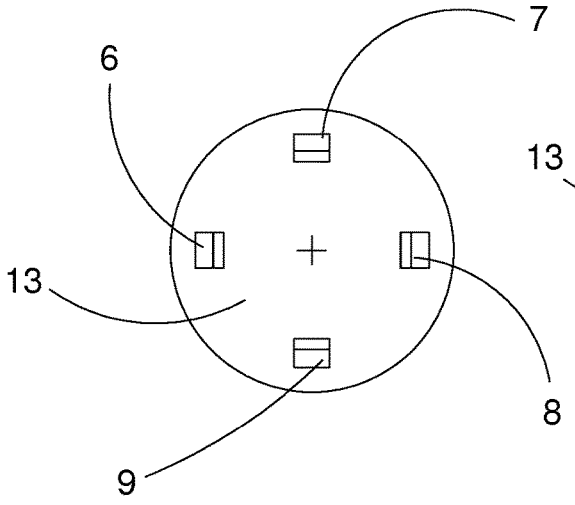
FIG. 3 shows a view onto the bottom inner side of the drinking glass.

FIG. 3 shows a view of the bottom inner side 13 of the drinking glass 2. There are four webs 6-9 depicted, whereas the number of webs can be at least three but also more than four.

Figure 4:
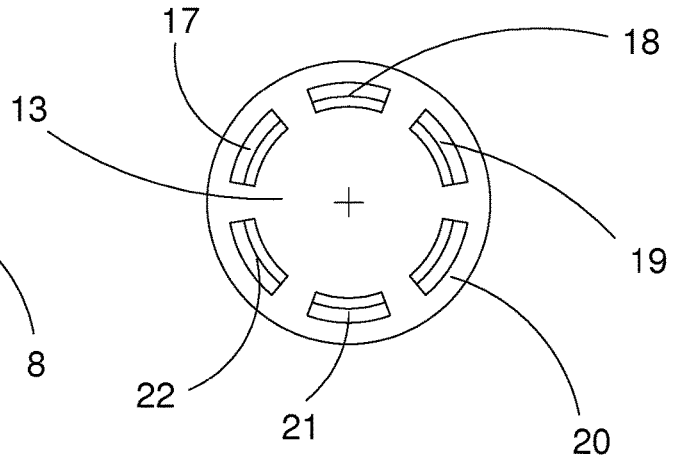
FIG. 4 shows a view onto the bottom inner side of a drinking glass in an alternative embodiment.

FIG. 4 depicts an alternative embodiment, which shows the lamellae 17-22, which are arranged in a ring-shape onto the bottom inner side 13, and which also contain the edges radially directed towards the inside according to the embodiment of FIG. 2. The lamellae form a cylinder that is split several times, which encompasses the bottle head with the crown cork 14 or ridge 15.

In a non-depicted way, the beverage bottle 1 can also contain a cork seal or screw cap, whereas the webs or lamellae in this case encompass the cork or seal cap with the appropriate adjustment in diameter.

The clamp principle can also be used with champagne bottles, even if these contain a wire-reinforcement.

Figure 5:
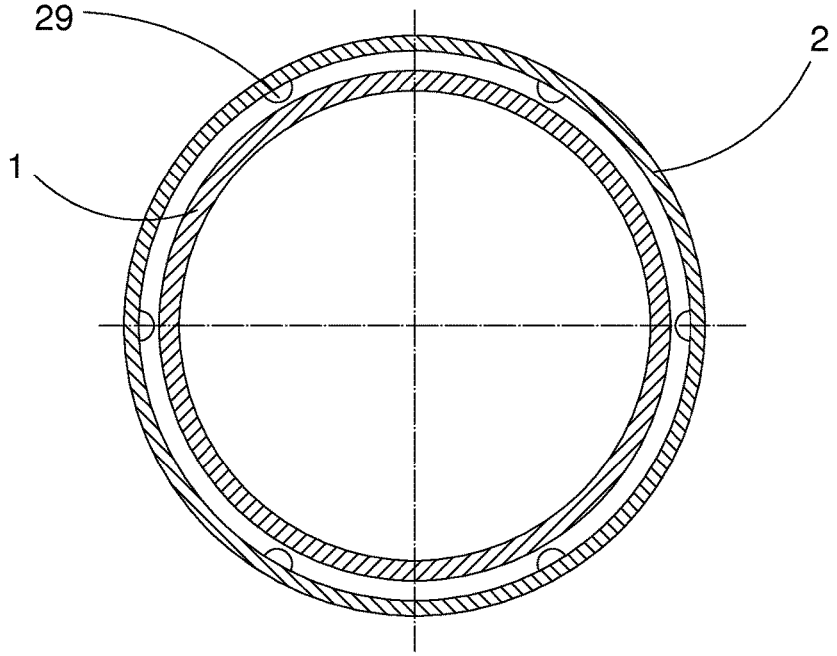
FIG. 5 shows a cross-section view through a combination of beverage bottle and drinking glass along line A-A of FIG. 2.

FIG. 5 shows a section view of a combination of a beverage bottle and drinking glass along line A-A in FIG. 2 in the cylindrical area of the beverage bottle 1. In order to avoid the formation of a vacuum when pulling off the drinking glass 2 from the beverage bottle 1, the drinking glass 2 shows several web-like profiles 29, which run into each other on the inside and in longitudinal or transversal direction, which protrude from the inside of the drinking glass and make out a gap between the inner wall of the drinking glass 2 and the outer wall of the beverage bottle 1. The profiles are made of the same material as the drinking glass 2 and can run in longitudinal direction of the drinking glass 2 to almost the entire length of it.

Figure 6:
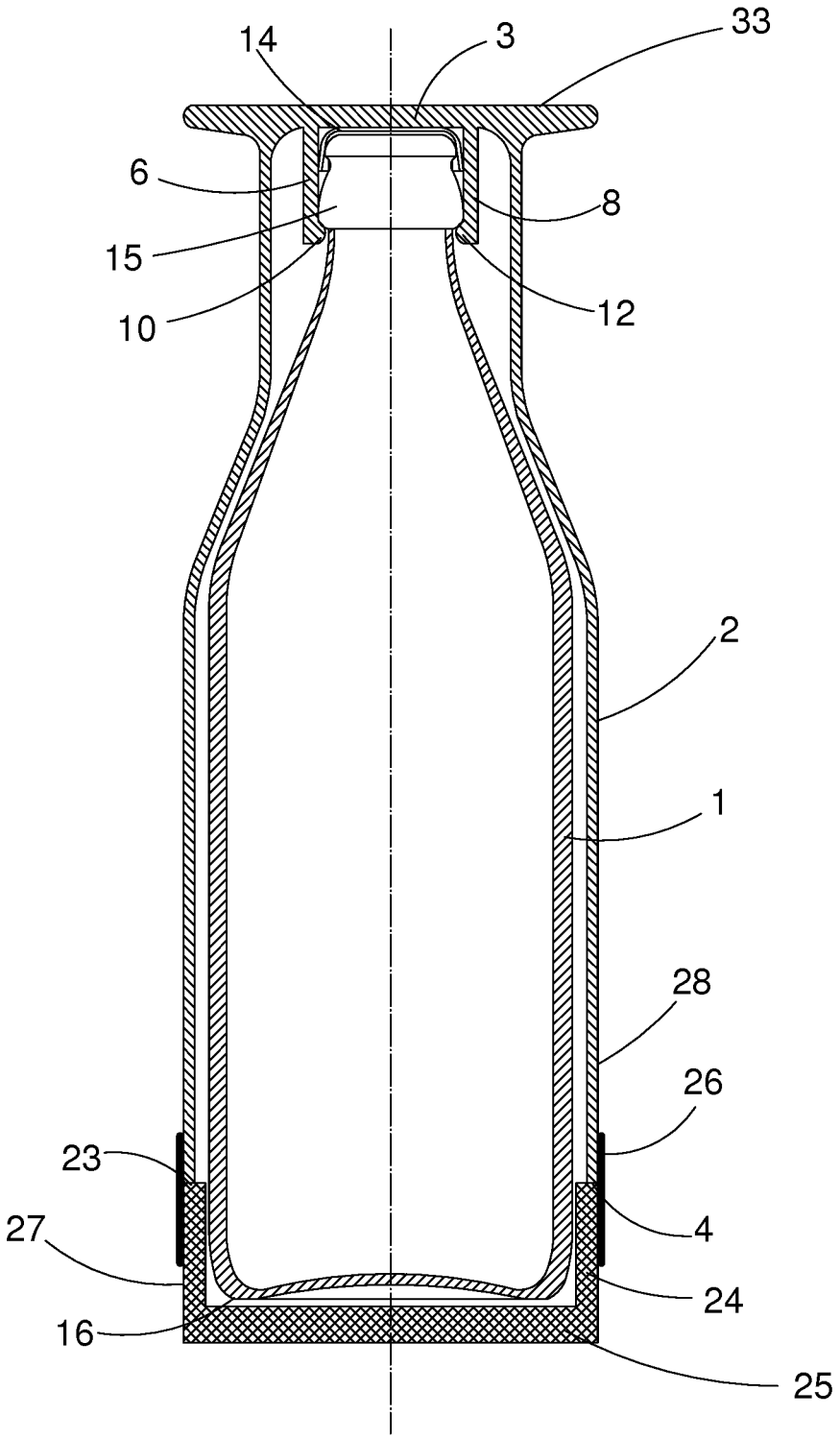
FIG. 6 shows a view according to FIG. 2 in an assembled state.

At the bottom of the flange 16 according to FIG. 6, a cover 25 can be attached, which contains a sideways flange 24, which is directed in axial direction of the beverage bottle 1 and shows an outside 27 and an upper side 23. The cover 25 approximately forms the shape of a coaster. When setting the drinking glass 2 onto the beverage bottle 1, the opening rim 4 of the drinking glass 2 touches the flange upper side 23 of the cover 25, so that there is an almost seamless transition between the drinking glass 2 and the flange 24. This transition can be covered with a banderole 26, which encompasses the bottom of exterior wall 28 of the drinking glass 2 and the outer wall 27 of the flange 24 of the cover 25. The banderole 26 on the one hand forms a security label and on the other hand protects the opening rim 4 of the drinking glass 2 from unhygienic influences.

FIG. 6, like FIG. 1, also shows a finished sales unit of beverage bottles and drinking glasses. When using a combination according to FIG. 6, first the banderole 26 is being removed, so that the cover 25 can be removed. Since the opening rim 4 of the drinking glass is approx. 1-2 cm above the bottom side 16 of the bottle, the rim of the bottle bottom can be gripped by hand and the drinking glass 2 can be pulled off from the bottle head. The drinking glass 2 can then be filled and used as usual. The beverage bottle 1 can be deposited back onto cover 25 or put onto the cover, when the flange is severed. The use of a banderole herein may also avoid the requirement to use of a clamp connection on the bottom inner side of the drinking glass.

For marketing and advertising purposes, the cover top and bottom are especially suitable as well as the top of the drinking glass bottom.

Figure 7:
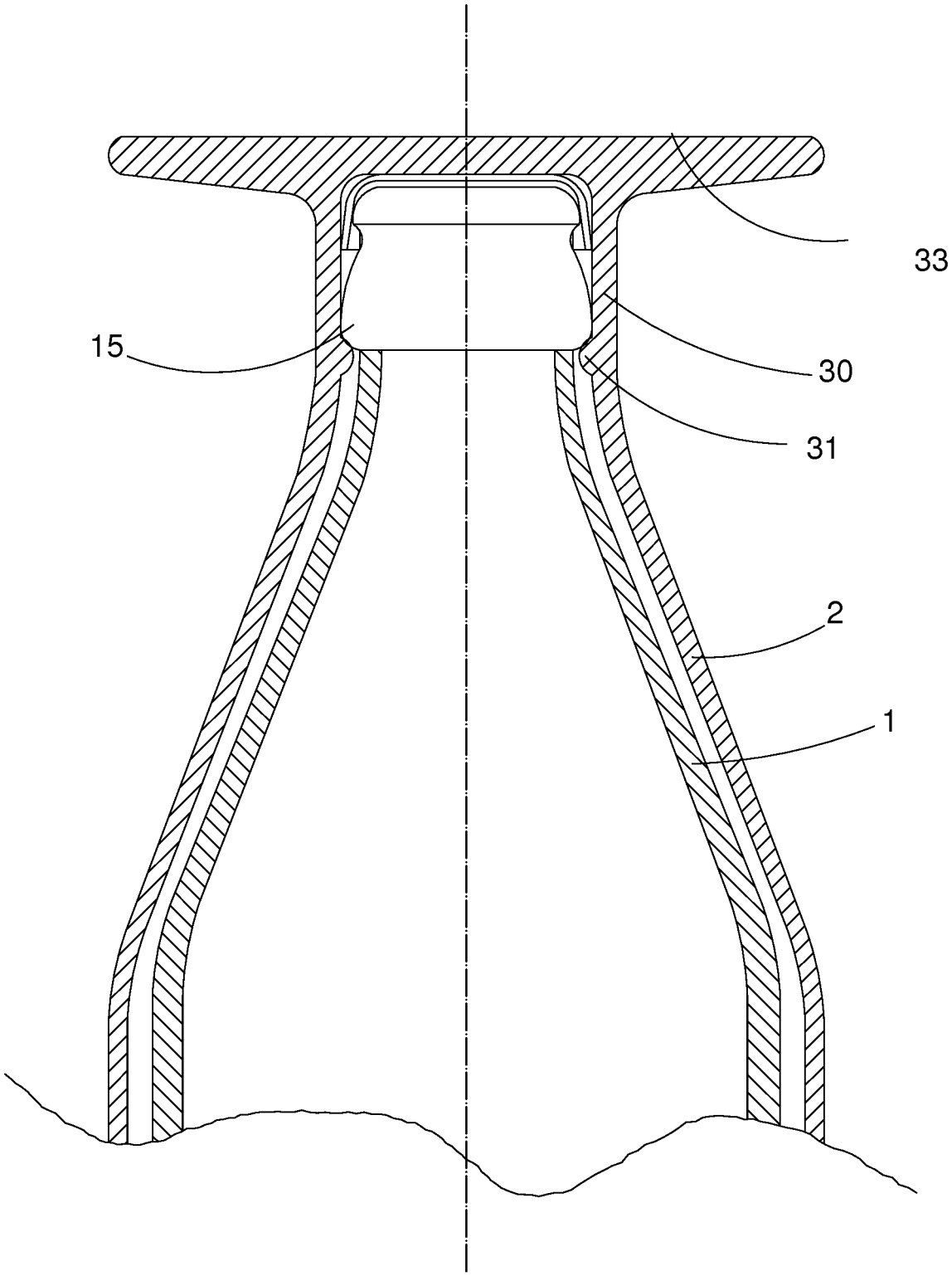
FIG. 7 shows an embodiment with edges at the interior bottleneck of a drinking glass.

Instead of webs 6-9 or lamellae 17-20 according to FIG. 6, the neck 30 of the drinking glass 2 can also be directly provided on the inside with edges 31, which reach the ridge 15, as in FIG. 7. These edges can be slightly flexible, spread over the interior of the neck 30, arranged as point-shaped edges or a circumferential, flexible ring can also be used. The flexibility needed for mounting can be provided in the edges, whereby also the slightly flexible material of the drinking glass supports the encompassing. In this embodiment, the neck of the drinking glass can be narrowly adjusted to the form of the beverage bottle, so that the outer form of the drinking glass almost entirely matches the form of the beverage bottles.

Figure 8:
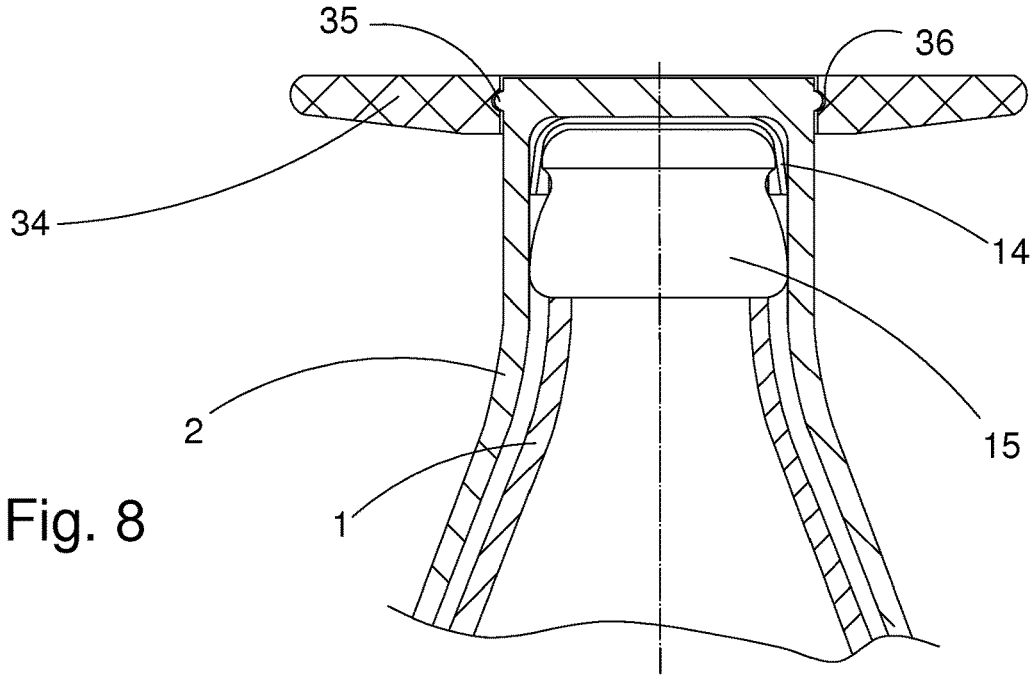
FIG. 8 shows an embodiment of a drinking glass with detachable foot part.

FIG. 8 shows a drinking glass 2 on the head of a beverage bottle 1, in which the foot part 34 of the drinking glass 2 is formed as a ring-like, separate piece and can be connected to the drinking glass by means of a ring-shaped nut 36 with a corresponding base 35 of the drinking glass. In this way, it is possible to produce and transport the drinking glass 2 and the foot part 24 separately, so that several drinking glasses can be stuck into each other over partial length to be transported easily. The pieces will only lock in place once the foot part is used or put onto the drinking glass with force.

Figure 9:
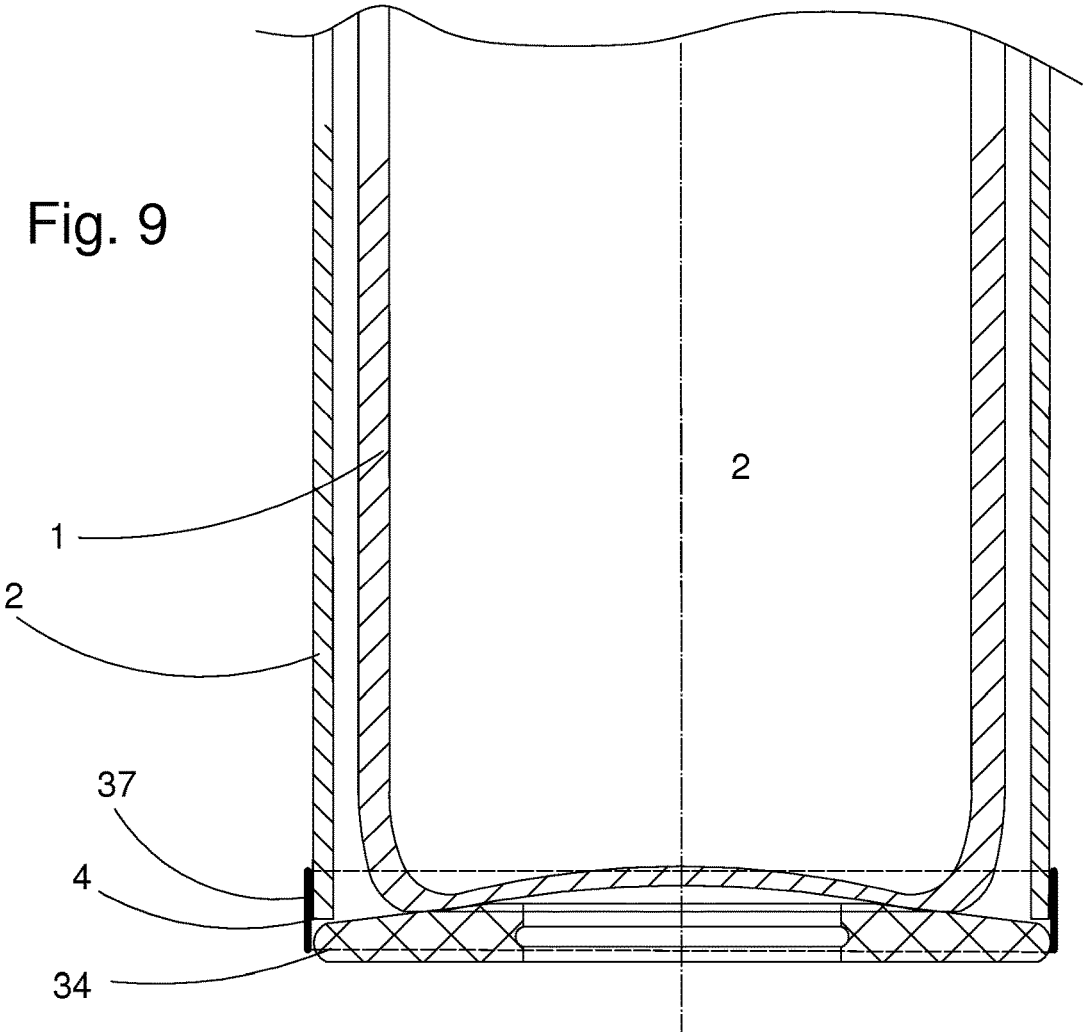
FIG. 9 shows an embodiment of a drinking glass with a foot part attached to the bottom.

According to FIG. 9, the foot part 34 can also be arranged in reverse direction to the bottom of the beverage bottle until its final usage, wherein a banderole 37 connects the opening rim 4 of the drinking glass to the outer rim of the foot part 34. After removing the banderole 37, the foot part 34 can be pushed onto the end of the drinking glass by the end user.

REFERENCE NUMERALS

Beverage bottle 20 lamella
Drinking glass 21 lamella
Drinking glass bottom 22 lamella
Opening rim 23 flange top
Banderole 24 flange
Web 25 cover
Web 26 banderole
Web 27 flange exterior
Web 28 outer wall
Edge 29 profile
Edge 30 neck
Edge 31 edges
Bottom inner side 32 distance
Crown caps 33 surface area
Ridge 34 foot part
Bottom of beverage bottle 35 base
Lamella 36 nut
Lamella 37 banderole
Lamella

What is claimed is:

1. A drinking glass and glass beverage bottle combination, the drinking glass having a bottom (3) and a wall and being detachably placed in the inverted direction over an upper end of the glass beverage bottle (1), wherein an inside wall of the drinking glass (2) at least partially surrounds the glass beverage bottle (1), characterized in that the inside wall of the drinking glass (2) follows, over an entire height of the drinking glass (2), an outer wall of the beverage bottle (1) at a slight distance of 1-3 mm therefrom, the beverage bottle being capped independently of the drinking glass, the inside wall of the drinking glass including a plurality of web-like longitudinal profiles (29) that protrude from the inner wall along essentially the full height of the drinking glass to define said slight distance to prevent creation of a vacuum between beverage bottle and glass when separated, wherein the drinking glass surrounds substantially the entire height of the beverage bottle, and wherein the drinking glass is able to accommodate essentially the entire volume of the beverage bottle, and the drinking glass (2) is fastened by a seal on an opening rim at the wall of the drinking glass to a lower end of the beverage bottle, the seal being detachable therefrom.

2. The drinking glass and glass beverage bottle combination according to claim 1, wherein the seal comprises an adhesive strip or adhesive tape applied circumferentially or in sections.

3. The drinking glass and glass beverage bottle combination according to claim 1, wherein a distance of the open rim of the drinking glass from a bottom side of the beverage bottle is 0.5-2 cm.

4. The drinking glass and glass beverage bottle combination according to claim 2, wherein the seal, provided by sections of adhesive tape, is formed by 1-4 horizontally or vertically directed adhesive or stick-on labels.

* * * * *